US007414541B2

(12) United States Patent
Bahn

(10) Patent No.: US 7,414,541 B2
(45) Date of Patent: Aug. 19, 2008

(54) VEHICLE COMMUNICATION DEVICE AND METHOD OF CONTROLLING THE SAME

(76) Inventor: Byoung Chul Bahn, 104-106, Hanbo Eunvit Maeul Apt., 360-2 Juyak-dong, Jinju-si, Gyeongsangnam-do (KR)

( * ) Notice: Subject to any disclaimer, the term of this patent is extended or adjusted under 35 U.S.C. 154(b) by 287 days.

(21) Appl. No.: 11/410,927

(22) Filed: Apr. 26, 2006

(65) Prior Publication Data

US 2006/0244633 A1 Nov. 2, 2006

(30) Foreign Application Priority Data

Apr. 29, 2005 (KR) ..... 10-2005-0036090

(51) Int. Cl.
*G08G 1/16* (2006.01)

(52) U.S. Cl. ..... 340/903; 340/902; 340/436

(58) Field of Classification Search ..... 340/902, 340/903, 904, 933, 426.16, 435, 436, 438; 356/5.02; 701/41, 96, 300, 301; 180/169
See application file for complete search history.

(56) References Cited

U.S. PATENT DOCUMENTS 5,969,969 A * 10/1999 Ejiri et al. ..... 701/41
6,268,803 B1 * 7/2001 Gunderson et al. ..... 340/903
6,311,123 B1 * 10/2001 Nakamura et al. ..... 701/96
6,567,737 B2 * 5/2003 Nakamura et al. ..... 701/96
6,684,149 B2 * 1/2004 Nakamura et al. ..... 701/96
6,903,680 B2 * 6/2005 Samukawa et al. ..... 342/173
7,209,221 B2 * 4/2007 Breed et al. ..... 356/5.02
7,271,762 B2 * 9/2007 Samukawa et al. ..... 342/173

* cited by examiner

*Primary Examiner*—Van T. Trieu
(74) *Attorney, Agent, or Firm*—Morgan, Lewis & Bockius LLP

(57) ABSTRACT

A vehicle communication device includes a plurality of transmitting and receiving sensors respectively are installed in the front and back side and the left and right side of a vehicle so as to transmit/receive driving information to/from neighboring vehicles, a left/right rotation signal detecting section detects a left or right rotation signal generated by a driver of the vehicle, a wheel angle detecting section detects a wheel rotation angle of the vehicle, a central control section transmits the driving information of the vehicle, including lane change or increase and reduction in speed, to the neighboring vehicle through the corresponding transmitting and receiving sensor, when a left or right rotation signal is detected through the left/right rotation signal detecting section, the detected wheel rotation angle of the vehicle changes more than a predetermined angle, or the detected speed of the vehicle changes more than or less than predetermined speed, and that outputs positional information of the neighboring vehicle with an alarm signal, when receiving the lane change or speed change information of the neighboring vehicle from an arbitrary transmitting and receiving sensor; and a driver information section that, when receiving the positional information of the neighboring vehicle with the alarm signal from the central control section, inform a driver of the information.

11 Claims, 5 Drawing Sheets

[FIG. 1]
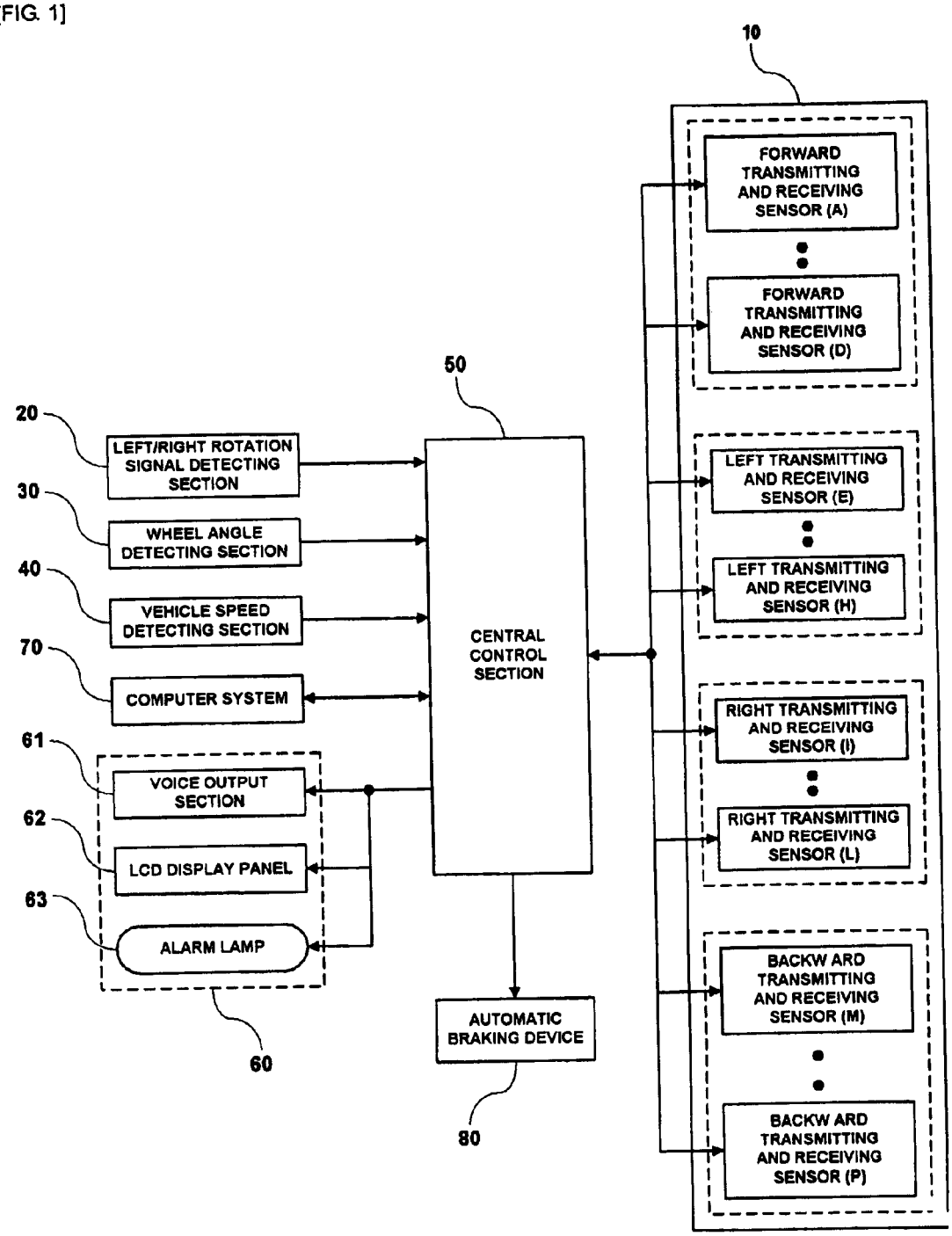

[FIG. 2]
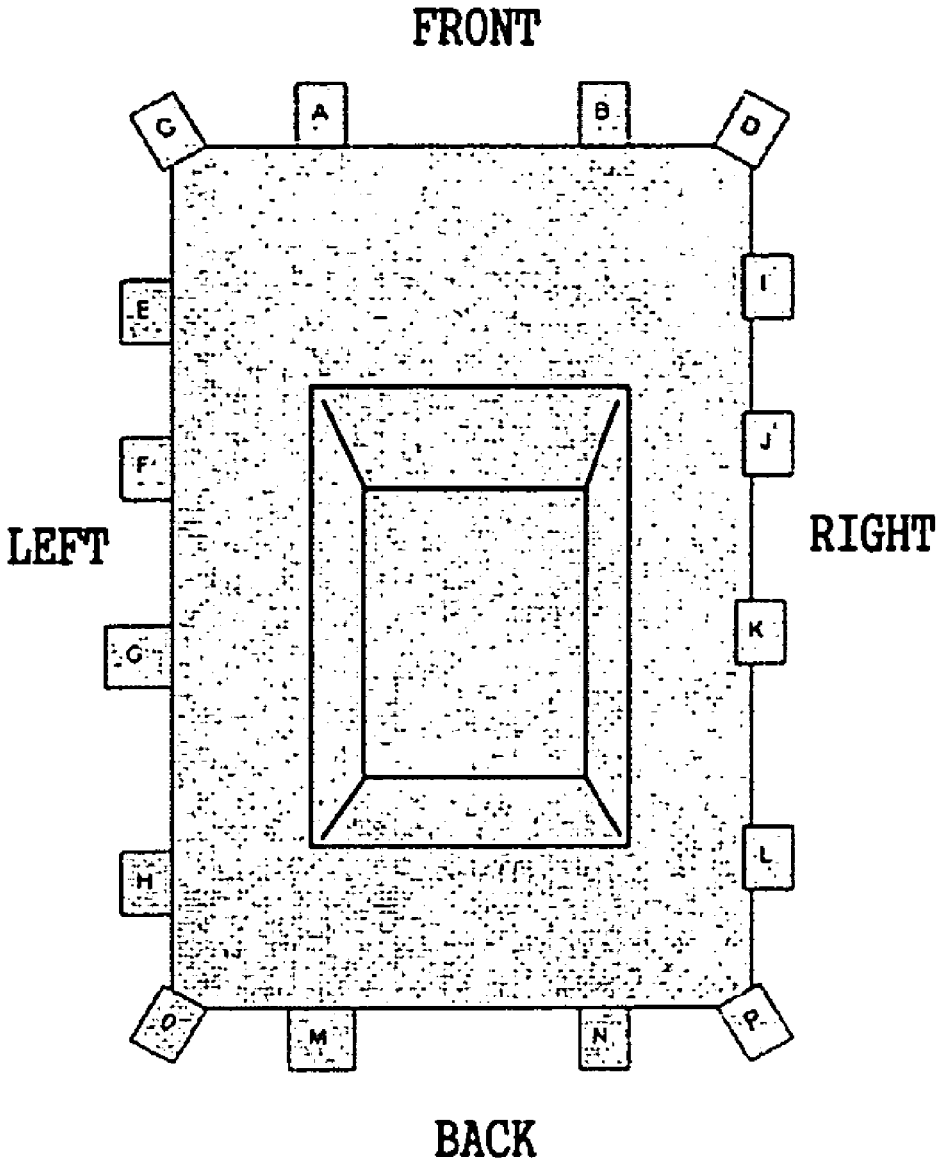

[FIG. 3]
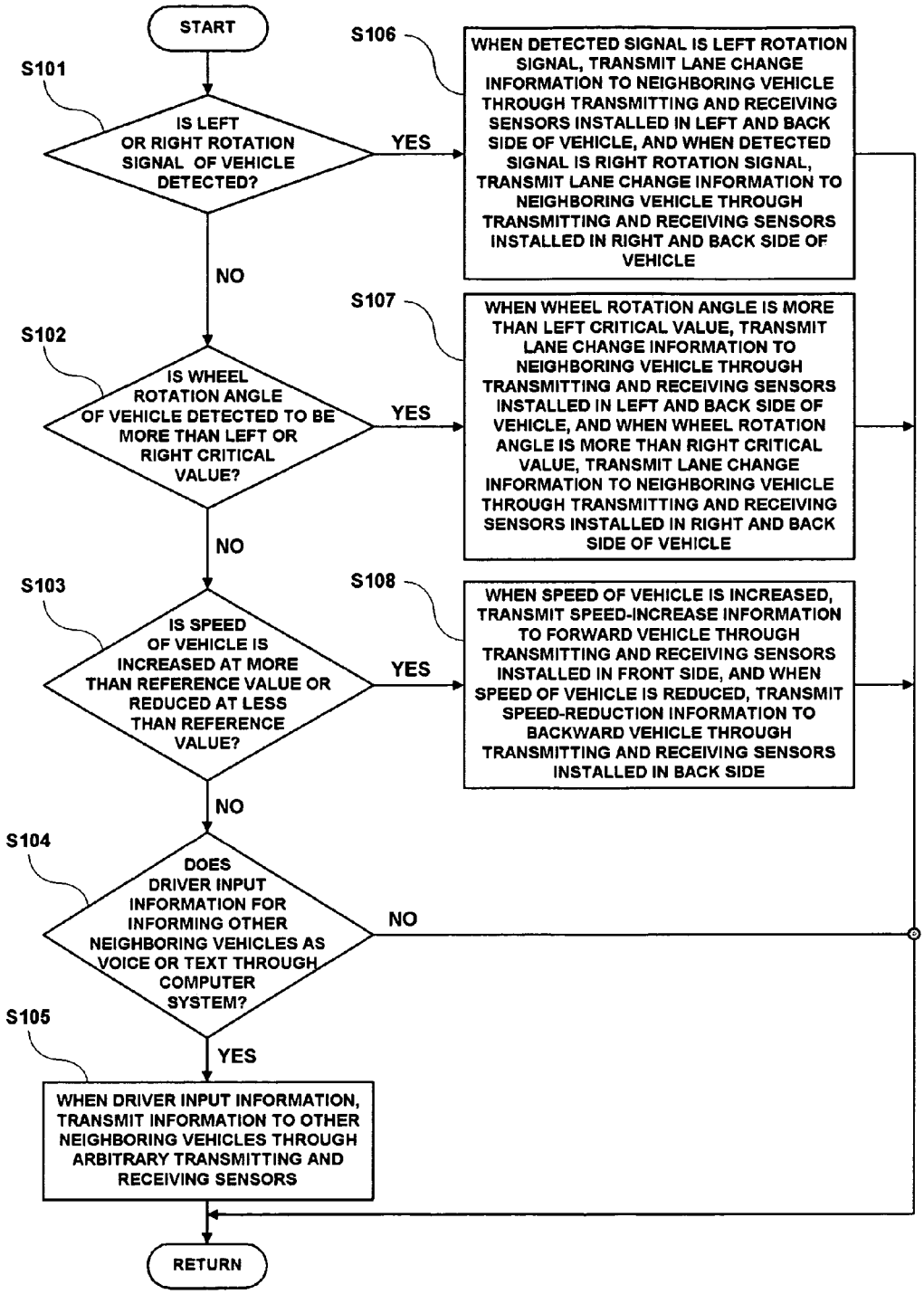

[FIG. 4]
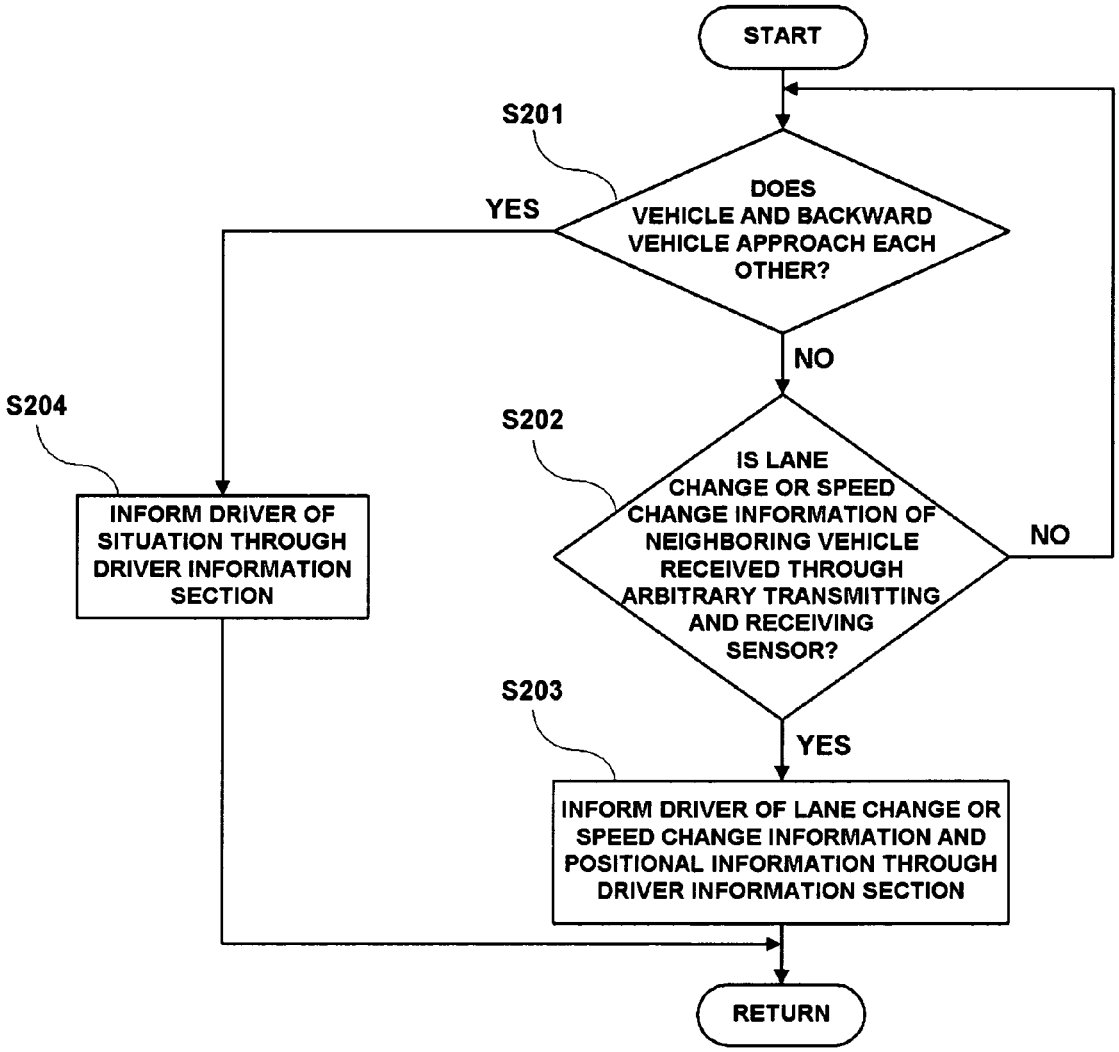

[FIG. 5]
[DRIVING DIRECTION]
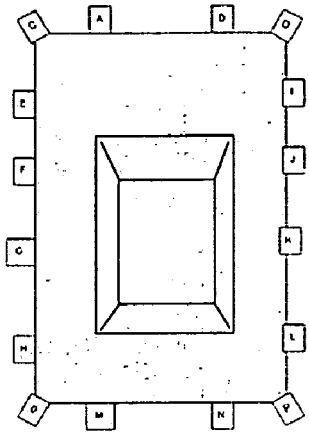
VEHICLE 1
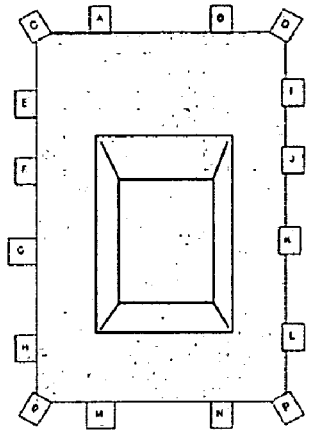
VEHICLE 2
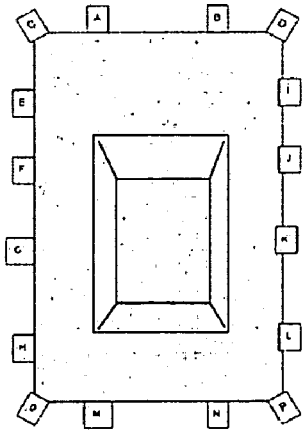
VEHICLE 3

VEHICLE COMMUNICATION DEVICE AND METHOD OF CONTROLLING THE SAME

CROSS-REFERENCE TO RELATED APPLICATIONS

The application claims the benefit of Korea Patent Application No. 2005-0036090 filed with the Korea Industrial Property Office on Apr. 29, 2005, the disclosure of which is incorporated herein by reference.

BACKGROUND OF THE INVENTION

1. Field of the Invention

The present invention relates to a vehicle communication device and a method of controlling the same, and more specifically, to a vehicle communication device, in which a plurality of transmitting and receiving sensors for transmitting and receiving information to and from neighboring vehicles are installed in the front and back side and the left and right side of a vehicle, so that all the vehicles can seek their safety together and a driver is provided with convenience, and a method of controlling the same.

2. Description of the Related Art

As generally known, a driver of a conventional vehicle turns on a left or right signal light in order to change a lane while driving. Further, when a driver steps on the brake so as to slow down the speed, flashing lights or rear lights mounted on the back side of the vehicle are operated to inform a backward driver of the information.

However, such a method is helpless when the weather becomes worse so that a visual field of a driver cannot be secured, when a driver changes a lane without operating signal light in accordance with his/her driving habit, or when a backward vehicle is positioned in a blind spot of a forward vehicle. Accordingly, a collision and rear-end collision due to lane change or sudden braking frequently occur.

As such problems occur, a device has been recently developed, including a short-distance ultrasonic sensor which is mounted on the back side of a high-class vehicle so as to maintain a safe following distance with a backward vehicle. However, the conventional device, which simply secures a safe following distance with a neighboring vehicle by using the short-distance ultrasonic sensor, cannot transmit and receive information to and from the neighboring vehicle. Therefore, when an accident occurs due to carelessness of another person, a collision or rear-end collision cannot help occurring.

SUMMARY OF THE INVENTION

An advantage of the present invention is that it provides a vehicle communication device, in which a plurality of transmitting and receiving sensors for transmitting and receiving information to and from neighboring vehicles are installed in the front and back side and the left and right side of a vehicle, so that an accident due to lane change and speed change of the vehicle can be previously prevented even when the vehicle is positioned in a blind spot or a visual field of a driver becomes narrow due to the bad weather, and a method of controlling the device.

Another advantage of the invention is that it provides a vehicle communication device, by which a message can be exchanged between drivers through a computer system installed in a vehicle, so that driver's convenience and vehicle's safety are improved, and a method of controlling the device.

Additional aspects and advantages of the present general inventive concept will be set forth in part in the description which follows and, in part, will be obvious from the description, or may be learned by practice of the general inventive concept.

According to an aspect of the invention, a vehicle communication device includes a plurality of transmitting and receiving sensors that respectively are installed in the front and back side and the left and right side of a vehicle so as to transmit and receive driving information to and from neighboring vehicles; a left/right rotation signal detecting section that detects a left or right rotation signal generated by a driver of the vehicle; a wheel angle detecting section that detects a wheel rotation angle of the vehicle; a vehicle speed detecting section that detects the speed of the vehicle; a central control section that transmits the driving information of the vehicle, including lane change or increase and reduction in speed, to the neighboring vehicle through the corresponding transmitting and receiving sensor, when a left or right rotation signal is detected through the left/right rotation signal detecting section, the wheel rotation angle of the vehicle detected through the wheel angle detecting section changes more than a predetermined angle, or the speed of the vehicle detected through the vehicle speed detecting section changes more than or less than predetermined speed, and that outputs positional information of the neighboring vehicle with an alarm signal, when receiving the lane change or speed change information of the neighboring vehicle from an arbitrary transmitting and receiving sensor; and a driver information section that, when receiving the positional information of the neighboring vehicle with the alarm signal from the central control section, inform a driver of the information.

According to another aspect of the invention, a method of controlling a vehicle communication device, by which the information is exchanged between a vehicle and other neighboring vehicles, includes judging whether a left or right rotation signal of the vehicle is detected or not; judging whether a wheel rotation angle of the vehicle is detected to be more than a left or right critical value, when a left or right rotation signal of the vehicle is not detected; judging whether the speed of the vehicle is increased at more than a reference value or reduced at less than the reference value, when the wheel rotation angle of the vehicle is not detected to be more than a left or right critical value; judging whether a driver inputs information for informing the other neighboring vehicles as a voice or text through a computer system, when the speed of the vehicle is not increased or reduced; and returning the step, when the driver does not input information for informing the other neighboring vehicles as a voice or text through a computer system, and transmitting the information to the other neighboring vehicles through arbitrary transmitting and receiving sensors, when the driver inputs the information.

According to a further aspect of the invention, a method of controlling a vehicle communication device, by which the information is exchanged between a vehicle and other neighboring vehicles, includes judging whether the vehicle and the backward vehicle approaches each other or not; judging whether information on lane change or speed change of the other neighboring vehicles is received through arbitrary transmitting and receiving sensors, when it is judged that the vehicle and the backward vehicle do not approach each other; and returning the step when information on lane change or speed change of the other neighboring vehicles is not received through arbitrary transmitting and receiving sensors, informing the driver of the information on lane change or speed change of the other neighboring vehicles with the positional information thereof when the information is received, and transmitting the driving situation of the vehicle in the direction where the information is received, through the transmitting and receiving sensor.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a block diagram showing the construction of a vehicle communication device according to an embodiment of the present invention;

FIG. 2 is a diagram showing a state where a plurality of transmitting and receiving sensors are respectively installed in the front and back side and the left and right side of a vehicle;

FIG. 3 is a flow chart showing a vehicle information transmitting method in a method of controlling the vehicle communication device according to the embodiment of the invention;

FIG. 4 is a flow chart showing a vehicle information receiving method in the method of controlling the vehicle communication device according to the embodiment of the invention; and FIG. 5 is a reference diagram for explaining the operation of the invention.

DETAILED DESCRIPTION OF THE PREFERRED EMBODIMENTS

Hereinafter, a vehicle communication device and a method of controlling the same according to an embodiment of the present invention will be described in detail with reference to the accompanying drawings.

FIG. 1 is a block diagram showing the construction of the vehicle communication device according to an embodiment of the invention. The vehicle communication device is composed of a plurality of transmitting and receiving sensors 10, a left/right rotation signal detecting section 20, a wheel angle detecting section 30, a vehicle speed detecting section 40, a central control section 50, a driver information section 60, a computer system 70, and an automatic braking device 80.

The plurality of transmitting and receiving sensors 10 are respectively installed in the front and back side and the left and right side of a vehicle, as shown in FIG. 2. When receiving the driving information of the vehicle from the central control section 50, the transmitting and receiving sensors 10 transmit the information to the neighboring vehicles. On the other hand, when receiving the driving information from the neighboring vehicles, the transmitting and receiving sensors 10 output the information to the central control section 50. In this case, any one of the plurality of transmitting and receiving sensors 10 installed in the back side of the vehicle emits an ultrasonic signal within 60 cm so as to detect how much a backward vehicle approaches. Then, the detected information is output to the central control section 50.

When the driver of the vehicle generates a left or right rotation signal, the left/right rotation signal detecting section 20 detects the signal to output to the central control section 50. The wheel angle detecting section 30 serves to detect a wheel rotation angle of the vehicle to output to the central control section 50, and the vehicle speed detecting section 40 serves to detect the speed of the vehicle to output to the central control section 50.

When a left or right rotation signal is detected by the left/right rotation signal detecting section 20, the wheel rotation angle of the vehicle detected by the wheel angle detecting section 30 changes more than a predetermined angle, or the speed of the vehicle detected by the vehicle speed detecting section 40 changes more than or less than a predetermined speed, the central control section 50 transmits the corresponding information of the vehicle, such as lane change or reduction and increase in speed, to the neighboring vehicles through the corresponding transmitting and receiving sensor 10. On the other hand, when receiving information of the neighboring vehicle, such as lane change or speed change, or information on how much the backward vehicle approaches, the central control section 50 generates an alarm signal corresponding thereto and outputs the positional information of the corresponding neighboring vehicle to the driver information section 60. At this time, the central control section 50 can grasp the positional information of the other neighboring vehicle by recognizing where an arbitrary transmitting and receiving sensor 10 is installed in the vehicle. The information on where the transmitting and receiving sensors 10 are installed is already stored in a memory (not shown).

When receiving the positional information of the other neighboring vehicle with an alarm signal from the central control section 50, the driver information section 60 informs a driver of the positional information. As shown in FIG. 1, the driver information section 60 is composed of a voice output section 61 which informs the positional information of the corresponding neighboring vehicle and the alarm signal corresponding thereto as a voice or alarm sound, an LCD display panel 62 which displays the positional information of the corresponding vehicle and the alarm signal corresponding thereto as a text or figure, and an alarm lamp 63 which is lit up when an alarm signal is input from the central control section 50.

When a driver inputs information for informing the other neighboring vehicles as a voice or text, the computer system 70 installed inside the vehicle outputs the information to the central control section 50 so as to exchange driver information between the vehicle and the other neighboring vehicles.

The automatic braking device 80 serves to automatically drive the brake of the vehicle when a forward vehicle is suddenly braked. When the traveling speed of the forward vehicle is rapidly reduced by more than a critical value, the automatic braking device 80 automatically drives the brake, regardless of the brake operation of the driver.

Then, the vehicle communication device having such a construction according to an embodiment of the invention and the method of controlling the same will be described with reference to the accompanying drawings. First, a method of transmitting vehicle information in the method of controlling the vehicle communication device will be described with reference to FIGS. 3 and 5.

The central control section 50 judges whether a left or right rotation signal of the vehicle is detected through the left/right rotation signal detecting section 20 or not (S101).

If the left or right signal of the vehicle is not detected in the step S101 (NO), the central control section 50 judges whether a wheel rotation angle of the vehicle is detected to be more than a left or right critical value through the wheel angle detecting section 30 or not (S102).

If the wheel rotation angle of the vehicle is not detected to be more than a left or right critical value in the step S102 (NO), the central control section 50 determines whether the speed of the vehicle is increased at more than a reference value or is reduced at less than the reference value through the vehicle speed detecting section 40 (S103).

If it is detected in the step S103 that the speed of the vehicle is not increased or reduced (NO), the central control section 50 judges whether the driver inputs information for informing the other neighboring vehicles as a voice or text through the computer system 70 (S104).

If the driver does not input information for informing the other neighboring vehicles as a voice or text through the computer system 70 in the step S104 (NO), the central control section 50 returns. On the other hand, if the driver inputs the information (YES), the central control section 50 transmits the information to the neighboring vehicles through arbitrary transmitting and receiving sensors 10 (S105).

When a left or right rotation signal of the vehicle is detected in the step S101 (YES), and if the signal is the left rotation signal, the central control section 50 transmits lane change information to the other vehicles positioned in the left and back side through the transmitting and receiving sensors 10 installed in the left (E to H) and back (M to P) side of the vehicle, as shown in FIG. 2. If the signal is the right rotation signal, the central control section 50 transmits lane change information to the other vehicles positioned in the right and back side through the transmitting and receiving sensors 10 installed in the right (I to L) and back (M to P) side of the vehicle (S106).

When a wheel rotation angle of the vehicle is detected to be more than a right or left critical value in the step S102 (YES), and if the detected wheel rotation angle is a rotation angle of more than the left critical value, the central control section 50 transmits lane change information to the other vehicles positioned in the left and back side through the transmitting and receiving sensors 10 installed in the left (E to H) and back (M to P) side of the vehicle, as shown in FIG. 2. If the detected wheel rotation angle is a rotation angle of more than the right critical value, the central control section 50 transmits lane change information to the other vehicles positioned in the right and left side through the transmitting and receiving sensors 10 installed in the right (I to L) and back (M to P) side of the vehicle (S107).

When it is detected in the step S103 that the speed of the vehicle is increased or reduced (YES), and if the speed of the vehicle is increased, the central control section 50 transmits speed-increase information to the other forward vehicle through the transmitting and receiving sensors 10 installed in the front (A to D) side, as shown in FIG. 2. If the speed of the vehicle is reduced, the central control section 50 transmits speed-reduction information to the other backward vehicle through the transmitting and receiving sensors 10 installed in the back (M to P) side (S108).

According to the method of transmitting vehicle information according to the embodiment of the invention, the exchange of driving information between vehicle 1 and vehicle 3 is possible even when the vehicle 3 is positioned in a blind spot of the vehicle 1, as shown in FIG. 5. Therefore, immediate handling is possible, thereby preventing a collision or rear-end collision.

A method of receiving vehicle information in the method of controlling the vehicle communication device according to the embodiment of the invention will be described with reference to FIG. 4.

The central control section 50 judges whether or not the vehicle and the backward vehicle approach each other, through the transmitting and receiving sensor 10 (M or N) installed in the back side of the vehicle (S201).

At this time, if it is judged in the step S201 that the vehicle and the backward vehicle does not approach each other (NO), the central control section 50 judges whether or not information on lane change or speed change of the other neighboring vehicle is received through an arbitrary transmitting and receiving sensor 10 (S202).

If information on lane change or speed change of the other neighboring vehicle is not received through an arbitrary transmitting and receiving sensor 10 in the step S202, the central control section 50 returns. If received, the information on lane change or speed change of the neighboring vehicle with the positional information thereof is informed to the driver through the driver information section 60. Then, the driving information of the vehicle is transmitted in a direction where the signal is received, through the transmitting and receiving sensor 10 (S203).

On the other hand, if it is judged in the step S201 that the vehicle and the backward vehicle approach each other (YES), the central control section 50 informs the driver of the situation through the driver information section 60.

The above-described vehicle communication device and the method of controlling the same can be variously applied to the information exchange between vehicles, and a specific example thereof will be described as follows.

First, when a forward vehicle which is traveling is suddenly braked, a backward vehicle is automatically braked by the automatic braking device 80 shown in FIG. 1 so as to maintain a constant distance with the suddenly-braked forward vehicle, thereby preventing a rear-end collision.

At this time, the central control section 50 drives the automatic braking device 80 before the driver steps on a brake, on the basis of the driving information, that is, the speed-reduction information which is provided from the transmitting and receiving sensor 10 installed in the back side of the forward vehicle.

When such obstacles as irregularities, falling rocks, puddle, animals or the like are found on driving, the first driver who has found the obstacles inputs a voice or text through the computer system 70 so as to notice the information on the road situation to the driver of the backward vehicle.

The driver of the backward vehicle who is informed of the information on the road situation warns in a manner where he/she provides the same information to another backward vehicle thereof, so that drivers of several vehicles can simultaneously recognize and meet the road situation.

In case of emergency, a driving lane can be easily secured for a special vehicle such as an ambulance, a fire truck, a police car or the like through such continuous information exchange between vehicles. Further, it is possible to prevent an accident of pedestrians who walk on a road of which the lane is wide.

The minor collision with a pedestrian occurs when a driver staring at a forward traffic light makes a start according to the traffic signal without recognizing the pedestrian. In order to prevent such an accident, the first driver who has found a pedestrian transmits a warning signal to the neighboring drivers through the transmitting and receiving sensor 10, and the other driver who receives the warning signal through the transmitting and receiving sensor 10 slows down the speed even though he/she cannot see the pedestrian. Therefore, when a pedestrian is found, the vehicle can be immediately braked to thereby prevent an accident.

The vehicle communication device and the method of controlling the same can be also used for the information exchange between vehicles in an intersection where a signal device is not present. Further, in an intersection where a signal device is present, the device and method can be used for counting the number of vehicles waiting for a signal through the respective transmitting and receiving sensors 10 thereof and providing the counting information to the signal device installed in the intersection so as to control the flow of vehicles.

In this case, the method of counting the number of waiting vehicles is where the first vehicle positioned in the intersection provides counting information to a backward vehicle and the backward vehicle receiving the counting information continuously provides counting information, which is incremented by one, to the next backward vehicle.

Afterwards, the last vehicle adds one to the counting information to transmit to the forward vehicle, and the forward vehicle transmits the final counting information to the next forward vehicle. By repeating such a process, the first vehicle receives the final counting information to provide to the signal device installed in the intersection.

At this time, the backward vehicle transmitting the final counting information can be set to a vehicle within a constant distance which is applied to the traffic light control flow in the intersection. The final counting information can be set as the number of vehicles which is optimum for the traffic light control flow.

Further, the device and method can be used for guiding a driver who is not familiar with a road or asking help because of the breakdown of a vehicle.

While the present invention has been described with reference to exemplary embodiments thereof, it will be understood by those skilled in the art that various changes and modifications in form and detail may be made therein without departing from the scope of the present invention as defined by the following claims.

According to the vehicle communication device and the method of controlling the same, the plurality of transmitting and receiving sensors are installed in the front and back side and the left and right side of the vehicle so that the driving information can be transmitted to the neighboring vehicle. Therefore, even though a vehicle is positioned in a blind spot or a visual field of a driver is narrowed due to a bad weather, it is possible to prevent an accident caused by lane change or speed change of the vehicle.

Further, the message directly input by the driver is transmitted to the neighboring vehicles through the computer system installed inside the vehicle, which makes it possible to improve the driver's convenience and the stability of the vehicle.

What is claimed is:

1. A vehicle communication device comprising:

a plurality of transmitting and receiving sensors that respectively are installed in the front and back side and the left and right side of a vehicle so as to transmit and receive driving information to and from neighboring vehicles;

a left/right rotation signal detecting section that detects a left or right rotation signal generated by a driver of the vehicle;

a wheel angle detecting section that detects a wheel rotation angle of the vehicle;

a vehicle speed detecting section that detects the speed of the vehicle;

a central control section that transmits the driving information of the vehicle, including lane change or increase and reduction in speed, to the neighboring vehicle through the corresponding transmitting and receiving sensor, when a left or right rotation signal is detected through the left/right rotation signal detecting section, the wheel rotation angle of the vehicle detected through the wheel angle detecting section changes more than a predetermined angle, or the speed of the vehicle detected through the vehicle speed detecting section changes more than or less than predetermined speed, and that outputs positional information of the neighboring vehicle with an alarm signal, when receiving the lane change or speed change information of the neighboring vehicle from an arbitrary transmitting and receiving sensor; and a driver information section that, when receiving the positional information of the neighboring vehicle with the alarm signal from the central control section, inform a driver of the information.

2. The vehicle communication device according to claim 1, wherein the driver information section includes:

a voice output section that informs the positional information of the neighboring vehicle and the corresponding alarm signal as a voice or alarm signal;

an LCD display panel that displays the positional information of the neighboring vehicle and the corresponding alarm signal as a text or figure; and a alarm lamp that is lit up when the alarm signal is input from the central control section.

3. The vehicle communication device according to claim 1, wherein any one of the plurality of transmitting and receiving sensors installed in the back side of the vehicle emits an ultrasonic signal within 60 cm so as to detect whether a backward vehicle approaches and then outputs the detected situation to the central control section, and when informed of the detected situation from the corresponding transmitting and receiving sensor, the central control section outputs the situation to the driver information section.

4. The vehicle communication device according to claim 1 further including a computer system that, when a driver input information for informing the neighboring vehicle as a voice or text, outputs the information to the central control section so as to exchange driver information between the vehicle and the neighboring vehicle.

5. The vehicle communication device according to any one of claims 1 to 4 further including an automatic braking device that automatically drives a brake when a forward vehicle which is moving is suddenly braked.

6. A method of controlling a vehicle communication device by which the information is exchanged between a vehicle and other neighboring vehicles, the method comprising:

judging whether a left or right rotation signal of the vehicle is detected or not;

judging whether a wheel rotation angle of the vehicle is detected to be more than a left or right critical value, when a left or right rotation signal of the vehicle is not detected;

judging whether the speed of the vehicle is increased at more than a reference value or reduced at less than the reference value, when the wheel rotation angle of the vehicle is not detected to be more than a left or right critical value;

judging whether a driver inputs information for informing the other neighboring vehicles as a voice or text through a computer system, when the speed of the vehicle is not increased or reduced; and returning the step, when the driver does not input information for informing the other neighboring vehicles as a voice or text through the computer system, and transmitting the information to the other neighboring vehicles through arbitrary transmitting and receiving sensors, when the driver inputs the information.

7. The method of controlling a vehicle communication device according to claim 6 further including transmitting lane change information to the other neighboring vehicles through the transmitting and receiving sensors installed in the left and back side of the vehicle, when a left or right rotation signal of the vehicle is detected and the detected signal is a left rotation signal, and transmitting lane change information to the other neighboring vehicles through the transmitting and receiving sensors installed in the right and back side of the vehicle, when the detected signal is a right rotation signal.

8. The method of controlling a vehicle communication device according to claim 6 further including transmitting lane change information to the other neighboring vehicles through the transmitting and receiving sensors installed in the left and back side of the vehicle, when the detected wheel rotation angle is more than a left critical value, and transmitting lane change information to the other neighboring vehicles through the transmitting and receiving sensors installed in the right and back side of the vehicle, when the detected wheel rotation angle is more than a right critical value.

9. The method of controlling a vehicle communication device according to claim 6 further including transmitting speed-increase information to the forward neighboring vehicle through the transmitting and receiving sensor installed in the front side of the vehicle, when it is judged that the speed of the vehicle is increased, and transmitting speed-reduction information to the backward neighboring vehicle through the transmitting and receiving sensor installed in the back side of the vehicle, when it is judged that the speed of the vehicle is reduced.

10. A method of controlling a vehicle communication device by which the information is exchanged between a vehicle and other neighboring vehicles, the method comprising:

judging whether the vehicle and the backward vehicle approaches each other or not;

judging whether information on lane change or speed change of the other neighboring vehicles is received through arbitrary transmitting and receiving sensors, when it is judged that the vehicle and the backward vehicle do not approach each other; and returning the step when information on lane change or speed change of the other neighboring vehicles is not received through arbitrary transmitting and receiving sensors, informing the driver of the information on lane change or speed change of the other neighboring vehicles with the positional information thereof when the information is received, and transmitting the driving situation of the vehicle in the direction where the information is received, through the transmitting and receiving sensor.

11. The method of controlling a vehicle communication device according to claim 10 including when it is judged that the vehicle and the backward vehicle approach each other, informing the driver of the situation through a driver information section.

* * * * *